US009308980B1

(12) United States Patent
Bonde et al.

(10) Patent No.: US 9,308,980 B1
(45) Date of Patent: Apr. 12, 2016

(54) EXPANSION OF IDLE RELIEF EXHAUST GASES IN OUTBOARD MOTORS

(71) Applicant: Brunswick Corporation, Lake Forest, IL (US)

(72) Inventors: Ryan G. Bonde, Kiel, WI (US); Michael J. Biel, Beaver Dam, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/333,206

(22) Filed: Jul. 16, 2014

(51) Int. Cl.
*B63H 21/34* (2006.01)
*B63H 20/24* (2006.01)

(52) U.S. Cl.
CPC ..... *B63H 20/245* (2013.01)

(58) Field of Classification Search
USPC ..... 440/89 G
IPC ..... B63H 20/26,20/245
See application file for complete search history.

(56) References Cited

U.S. PATENT DOCUMENTS

| | | | | |
|---|---|---|---|---|
| 4,036,162 | A | 7/1977 | Maier et al. | |
| 4,507,092 | A * | 3/1985 | Hall | F01N 13/12 440/77 |
| 4,668,199 | A | 5/1987 | Freund et al. | |
| 4,799,905 | A * | 1/1989 | Broughton | F01N 13/12 181/235 |
| 4,952,182 | A | 8/1990 | Curtis et al. | |
| 5,041,036 | A | 8/1991 | Clark et al. | |
| 5,733,157 | A * | 3/1998 | Okuzawa | F02B 61/045 123/195 P |
| 7,074,097 | B1 * | 7/2006 | Seymour, II | B63H 21/34 440/89 R |
| 7,892,057 | B1 | 2/2011 | Belter | |
| 8,475,222 | B2 * | 7/2013 | Ishizaka | B63H 20/28 440/88 C |

* cited by examiner

*Primary Examiner* — Stephen Avila
(74) *Attorney, Agent, or Firm* — Andrus Intellectual Property Law, LLP

(57) ABSTRACT

An outboard motor has an adapter plate that supports an internal combustion engine, a driveshaft housing disposed below the adapter plate, and a lower cowl. A lower cowl volume is defined between the adapter plate, cowl and driveshaft housing. A lower cowl volume inlet is configured to supply idle relief exhaust gases to the lower cowl volume and a lower cowl volume outlet is configured to discharge idle relief exhaust gases from the lower cowl volume to atmosphere. The lower cowl volume is configured to cause expansion of the relief exhaust gases prior to discharge of the idle relief exhaust gases to atmosphere.

17 Claims, 4 Drawing Sheets

EXPANSION OF IDLE RELIEF EXHAUST GASES IN OUTBOARD MOTORS

FIELD

The present disclosure relates to outboard motors and more particularly to expansion of idle relief exhaust gases in outboard motors.

BACKGROUND

U.S. Pat. No. 4,668,199 discloses an exhaust system for an outboard motor including a main exhaust passageway extending through a partially water filled chamber in the driveshaft housing. An inlet idle relief passage connects the top of the chamber with the main exhaust passageway and an outlet passage connects the top of the chamber with the atmosphere.

U.S. Pat. No. 4,952,182 discloses an exhaust relief system for an outboard motor including an exhaust chamber into which exhaust is discharged from the engine. A first passage in communication with the exhaust chamber provides contraction of the exhaust as the exhaust passes rearwardly, from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system of the invention, along with the repeated expansion and contraction of the exhaust as it flows to atmosphere, provides a muffling effect at idle operation.

U.S. Pat. No. 5,041,036 discloses an outboard motor comprising an internal combustion engine including a lower surface having therein an exhaust gas discharge port, a driveshaft housing having an upper end including an upper face fixed to the lower surface of the internal combustion engine, an outer surface extending downwardly from the upper face, an interior vertically extending main exhaust gas passage extending from the upper face and communicating with the exhaust gas discharge port, an idle relief exhaust gas relief passage recessed in the upper face and in spaced relation to the main exhaust gas passage, and closed by the lower surface of the internal combustion engine, and an idle exhaust gas outlet port located in the outer surface and communicating with the idle exhaust gas relief passage, and an idle exhaust gas relief tube communicating between the main exhaust gas passage and the idle exhaust gas relief passage and having a portion extending vertically within the main exhaust gas passage and terminating in spaced relation above the water level in the driveshaft housing when the driveshaft housing is located in a normal operating position and when the driveshaft housing is at rest relative to the water.

U.S. Pat. No. 7,892,057 discloses an idle exhaust relief passage provided with a valve that can inhibit flow through the passage in response to certain operating conditions of an engine of an outboard motor. More particularly, operation above a predetermined threshold can be used to inhibit flow through the idle exhaust relief passage. A valve, configured for this purpose, can be a flapper valve.

U.S. Patent Application Publication No. 2014/0057508 discloses a marine propulsion system for propelling a marine vessel in water. The system comprises an outboard motor that is coupled to a marine vessel, and that comprises an exhaust gas relief outlet that is located above the water when the outboard motor is at idle speed. A conduit conveys exhaust gas from the exhaust gas relief outlet to a discharge outlet located on the marine vessel.

The disclosures of each of the above-mentioned patents and patent application publication are hereby incorporated by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter. In certain examples, an outboard motor comprises an adapter plate that supports an internal combustion engine; a driveshaft housing that is suspended below the adapter plate; a lower cowl that surrounds the driveshaft housing; a lower cowl volume that is defined between the adapter plate, the lower cowl, and the driveshaft housing; a lower cowl volume inlet that is configured to supply relief exhaust gases to the lower cowl volume; and a lower cowl volume outlet that is configured to discharge the relief exhaust gases from the lower cowl volume to atmosphere surrounding the outboard motor. The lower cowl volume is configured to cause expansion of the relief exhaust gases prior to discharge of the relief exhaust gases to the atmosphere.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
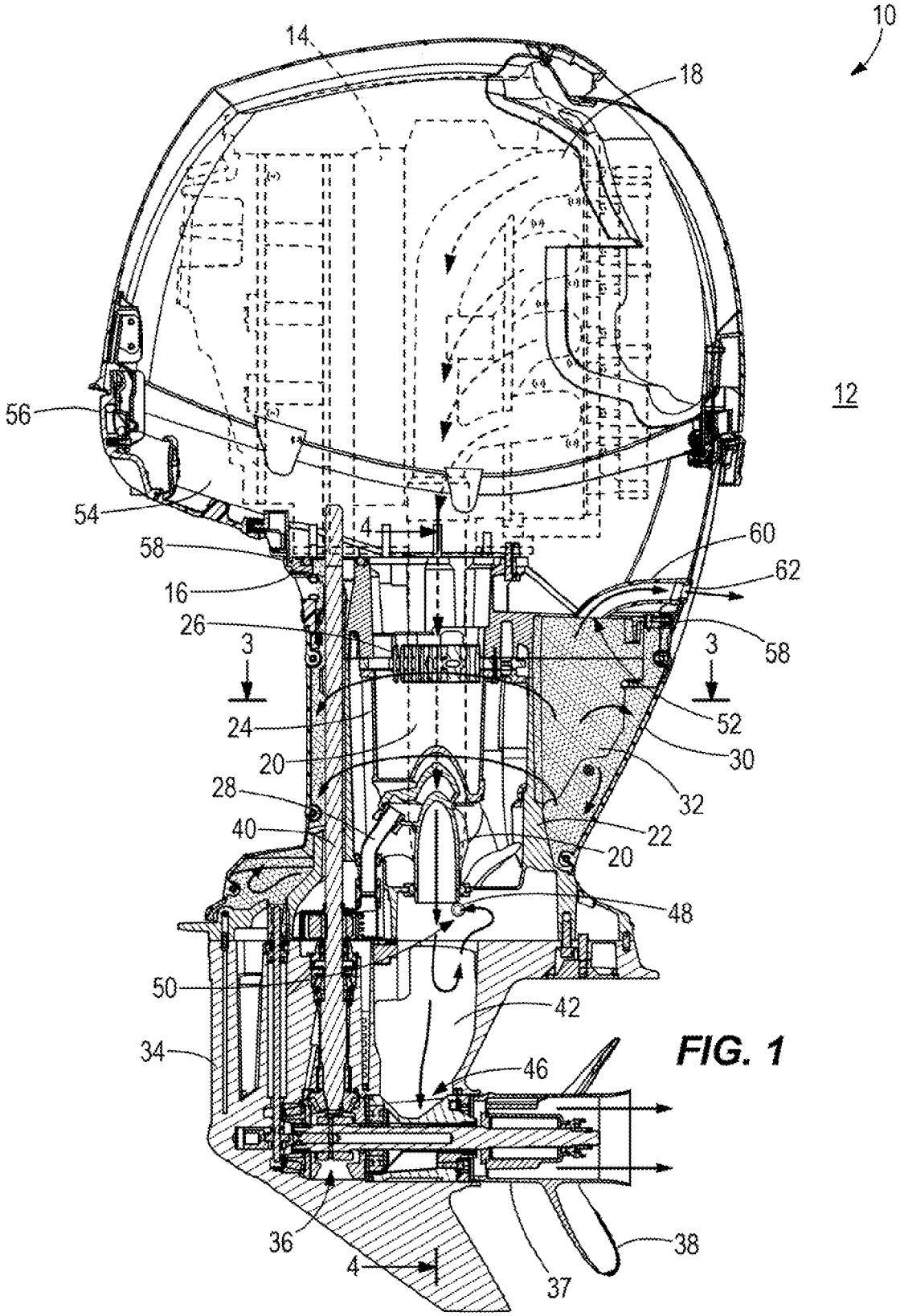
FIG. 1 is a side sectional view of an outboard motor according to the present disclosure.
Figure 2:
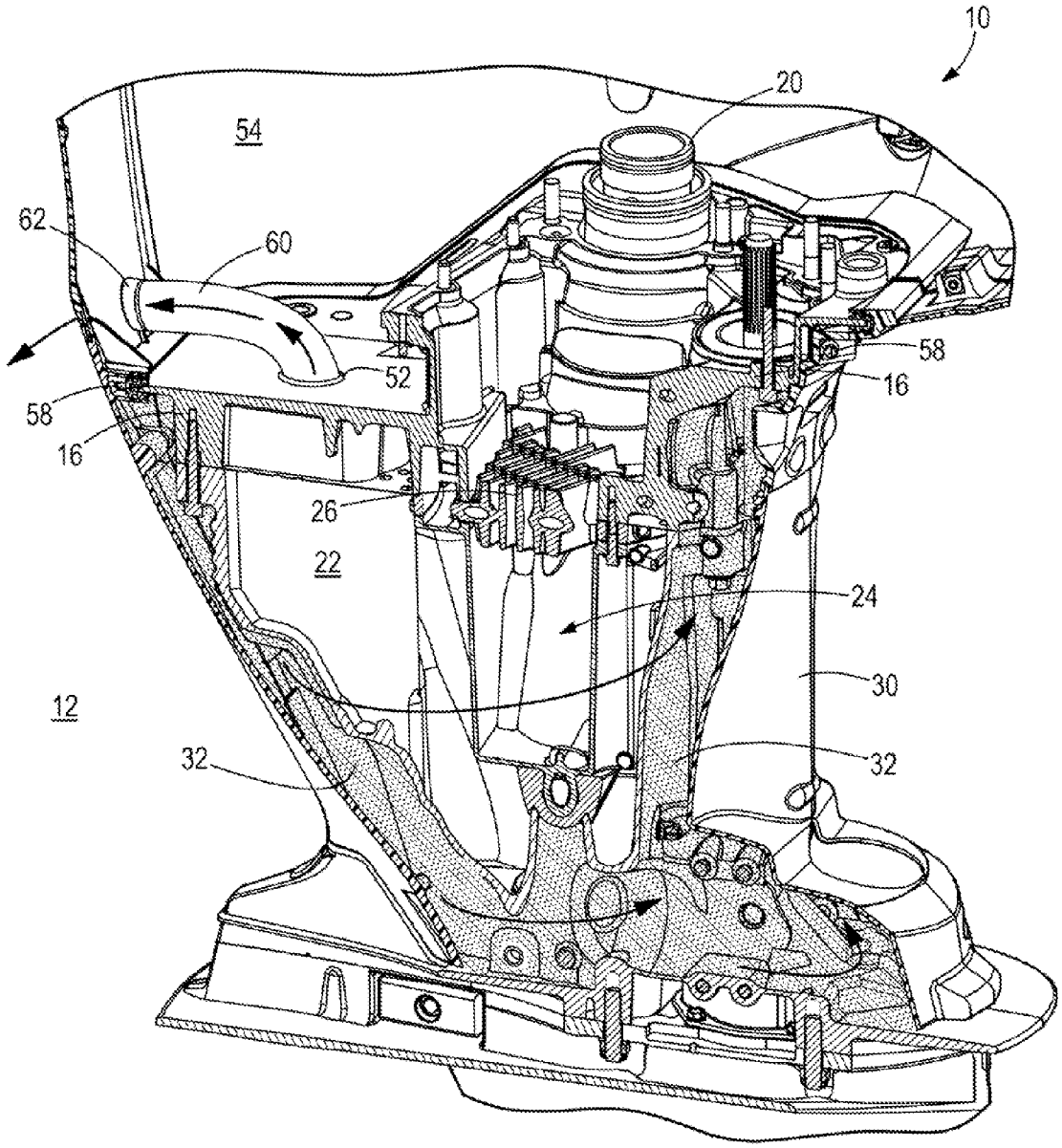
FIG. 2 is a partial perspective sectional view of the outboard motor shown in FIG. 1.
Figure 3:
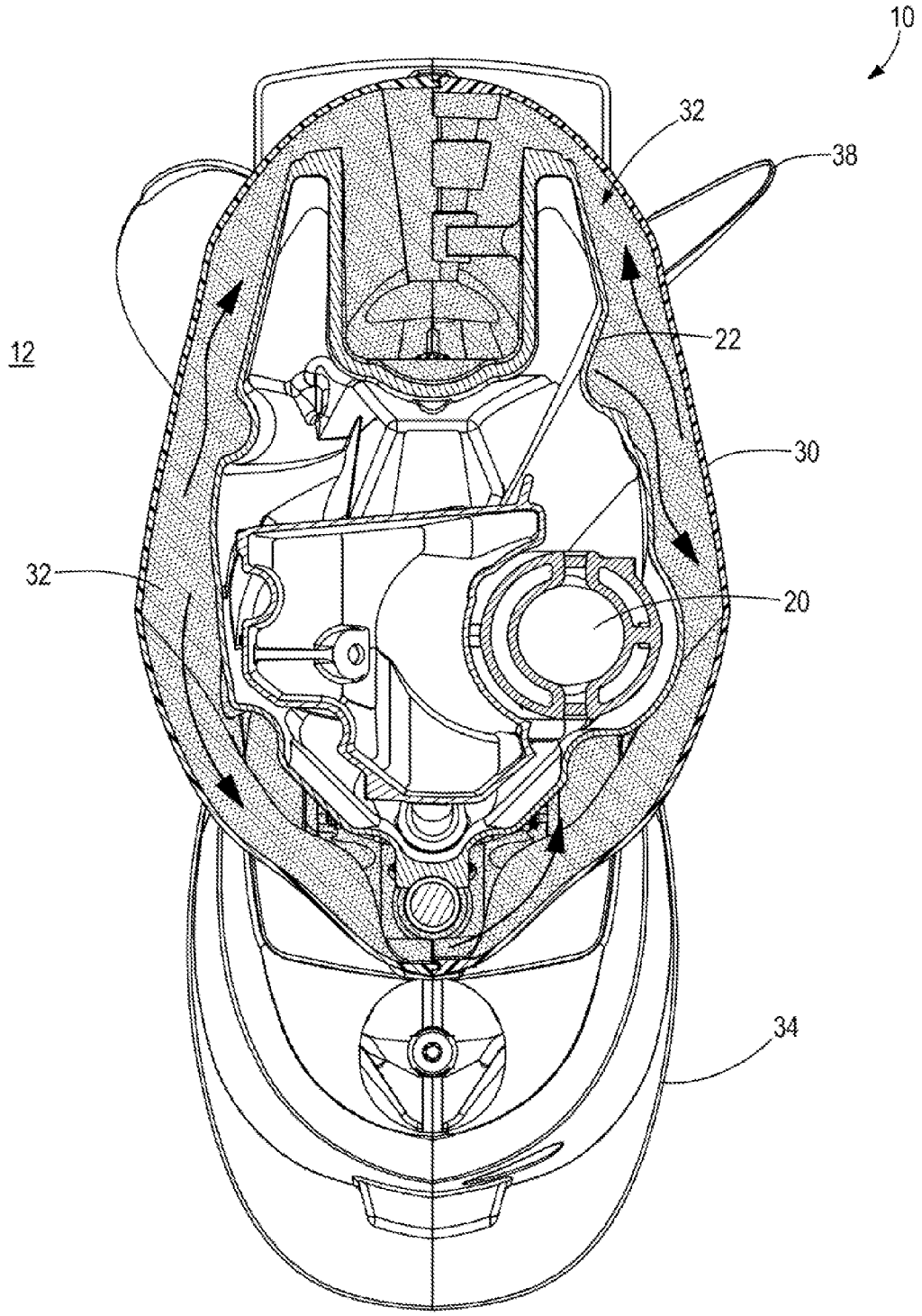
FIG. 3 is a view of section 3-3, taken in FIG. 1.
Figure 4:
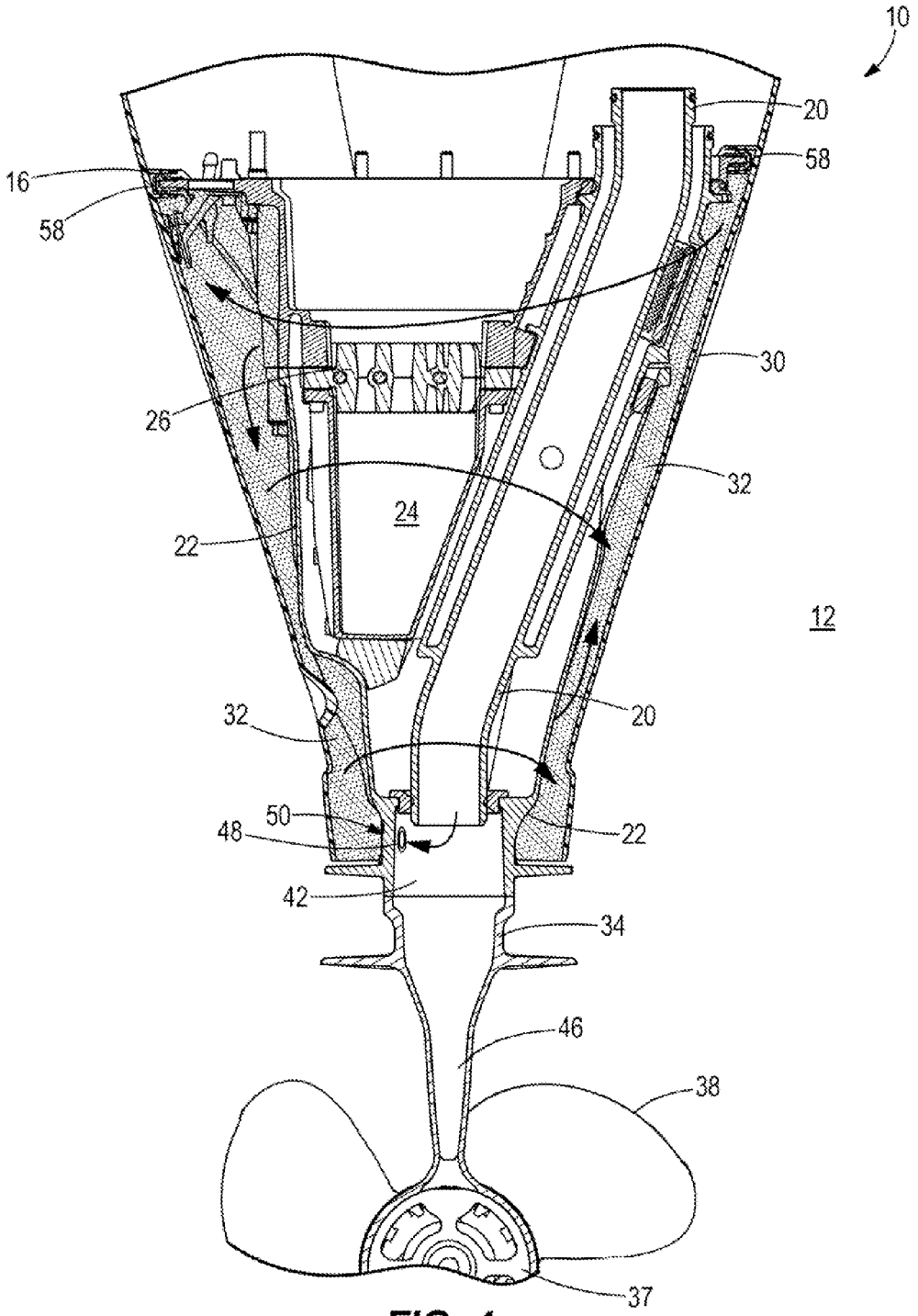
FIG. 4 is a view of section 4-4, taken in FIG. 1.

FIGS. 1-4 depict an outboard motor 10. The outboard motor 10 includes an internal combustion engine 14 that is supported by an adapter plate 16. The engine 14 has a plurality of piston-cylinders (not shown) which discharge exhaust gases to an exhaust manifold 18. Exhaust gases in the exhaust manifold 18 are conveyed downwardly through the outboard motor 10 via an exhaust tube 20 that extends through the adapter plate 16 and past a driveshaft housing 22 that is suspended below the adapter plate 16. The driveshaft housing 22 contains, among other things, an oil sump 24 that holds oil for lubrication of the engine 14 and an oil cooler 26 for cooling the noted oil contained in the oil sump 24. A cooling water line 28 extends into the driveshaft housing 22 and supplies cooling water for cooling the exhaust tube 20, exhaust manifold 18, and portions of the engine 14, etc. A gear case housing 34 is disposed below the driveshaft housing 22 and contains a transmission 36 for causing a propeller 38 based upon rotation of a driveshaft 40 extending from the engine 14.

As further explained herein below, the outboard motor 10 is configured such that portions of the exhaust gases in the form of idle relief exhaust gases are discharged from the outboard motor 10 to atmosphere 12 surrounding the outboard motor 10 when the engine 14 is operated at idle speeds. A lower cowl 30 surrounds the driveshaft housing 22 and protects the interior of the outboard motor 10 from environmental elements, such as wind, waves and the like. A lower cowl volume 32 is defined between the adapter plate 16, the lower cowl 30, and the driveshaft housing 22. In this example, the lower cowl volume 32 surrounds the driveshaft housing 22. According to the present disclosure, the lower cowl volume 32 is configured and utilized to cause expansion of the noted relief exhaust gases prior to discharge of the relief exhaust gases to the atmosphere 12.

The exhaust tube 20 is configured to convey exhaust gases from the engine 14, past the lower cowl volume 32, for discharge from the outboard motor 10 via the gear case housing 34. The exhaust tube 20 is configured to discharge exhaust gases from the engine 14 to an exhaust gas volume 42 that is located below the lower cowl volume 32. In this example, the exhaust gas volume 42 exists between the driveshaft housing 22 and the gear case housing 34. Exhaust gases from the engine 14 exits the lower end 44 of the exhaust tube 20 and fill the exhaust gas volume 42. Thereafter, the exhaust gases exit the exhaust gas volume 42 via a passageway 46 formed in the gear case housing 34 for discharge from the outboard motor 10 via the hub 37 of the propeller 38.

During operation of the outboard motor 10 at low speed and/or at idle speed, the exhaust gas in the exhaust gas volume 42 typically does not have a high enough pressure to overcome the pressure of water surrounding the propeller 38. As such, the exhaust gases in the exhaust gas volume 42 typically will not exit the outboard motor 10 via the passageway 46. Advantageously, the outboard motor 10 includes means for discharging at least a portion of the exhaust gases in the form of relief exhaust gases to the atmosphere 12. A lower cowl volume inlet 50 includes a passage 48 that conducts relief exhaust gas from the exhaust gas in the exhaust gas volume 42 to the lower cowl volume 32. In this example the passage 48 extends through the driveshaft housing 22. Upon entry into the lower cowl volume 32 the relief exhaust gas expands. A lower cowl volume outlet 52 is configured to discharge the expanded relief exhaust gases from the lower cowl volume 32 to the atmosphere 12 surrounding the outboard motor 10. In this example, the lower cowl volume inlet 50 is formed in the driveshaft housing 22. The lower cowl volume outlet 52 is formed in the adapter plate 16. However the location of the lower cowl volume inlet 50 and lower cowl volume outlet 52 can vary. For example the lower cowl volume outlet 52 could instead be formed in the lower cowl 30.

The engine 14 is located in an engine compartment 54 defined by an upper cowl 56 that is supported by the adapter plate 16. A cowl seal 58 is formed between the adapter plate 16 and the lower cowl 30 such that the cowl seal 58 separates the engine compartment 54 from the lower cowl volume 32. In this example, a conduit 60 is configured to convey relief exhaust gas from the lower cowl volume outlet 52 through the engine compartment 54 to the atmosphere 12 via an opening 62 formed in the upper cowl 56. The conduit 60 has a first end connected to the lower cowl volume outlet 52 in the adapter plate 16 and a second end connected to the opening 62 formed in the upper cowl 56. Again, the configuration of the lower cowl volume outlet can vary from that which is shown. For example the lower cowl volume outlet 52 can be located on the lower cowl 30 instead of or in addition to the adapter plate 16.

The present disclosure thus provides a method of expanding relief exhaust gases in an outboard motor 10 having an adapter plate 16 that supports the engine 14. A driveshaft housing 22 is suspended below the adapter plate 16 and a lower cowl 30 surrounds the driveshaft housing 22. Relief exhaust gases are supplied to the lower cowl volume 32, which is defined between the adapter plate 16, the lower cowl 30 and the driveshaft housing 22. The lower cowl volume 32 is sized larger than the exhaust gas volume 42 and the lower cowl volume inlet 50 and thus is configured to cause expansion of the relief exhaust gases, reducing exhaust noise. The expanded relief exhaust gases are discharged to atmosphere.

Through research and experimentation, the present inventors have found that routing the relief exhaust gases through the lower cowl volume advantageously reduces exhaust noise at idle speeds to satisfactory levels and also provides an efficient use of space within the outboard motor. By routing the relief exhaust gases to the lower cowl volume, components typically used to expand and/or reduce noise such as mufflers and silencers can be reduced in size and/or eliminated altogether, thus saving space and cost.

In the above description, certain terms have been used for brevity, clarity, and understanding. No unnecessary limitations are to be inferred therefrom beyond the requirement of the prior art because such terms are used for descriptive purposes and are intended to be broadly construed. The different apparatuses and methods described herein may be used alone or in combination with other apparatuses and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. An outboard motor comprising:

an internal combustion engine;

an adapter plate that supports the engine;

a driveshaft housing that is suspended below the adapter plate;

a lower cowl that surrounds the driveshaft housing;

a lower cowl volume that is defined between the adapter plate, the lower cowl and the driveshaft housing;

a lower cowl volume inlet that is configured to supply relief exhaust gases to the lower cowl volume; and a lower cowl volume outlet that is configured to discharge the relief exhaust gases from the lower cowl volume to atmosphere surrounding the outboard motor;

wherein the lower cowl volume is configured to cause expansion of the relief exhaust gases prior to discharge of the relief exhaust gases to the atmosphere without passing through an intervening labyrinth structure;

wherein the exhaust tube is configured to discharge the exhaust gas to an exhaust gas volume that is located below the lower cowl volume; and wherein the exhaust gas volume is at least partially separated from the lower cowl volume by the driveshaft housing.

2. The outboard motor according to claim 1, comprising a gear case housing that is disposed below the driveshaft housing and that contains a transmission for the outboard motor, and further comprising an exhaust tube that is configured to convey exhaust gas from the engine past the lower cowl volume for discharge from the outboard motor via the gear case housing.

3. The outboard motor according to claim 1, wherein the exhaust gas volume exists between the gear case housing and the driveshaft housing.

4. The outboard motor according to claim 1, comprising a relief exhaust passage having a first end receiving the relief exhaust gases from the exhaust gas in exhaust gas volume and a second end discharging the relief exhaust gases to the lower cowl volume.

5. The outboard motor according to claim 4, wherein the relief exhaust passage extends through the driveshaft housing.

6. The outboard motor according to claim 1, wherein exhaust gas is discharged from the outboard motor via the gear case housing.

7. The outboard motor according to claim 1, wherein the engine is located in an engine compartment defined by an upper cowl that is supported by the adapter plate; and further comprising a cowl seal between the adapter plate and the lower cowl, wherein the cowl seal separates the engine compartment from the lower cowl volume.

8. The outboard motor according to claim 7, wherein the lower cowl volume outlet is formed in the adapter plate.

9. The outboard motor according to claim 8, comprising a conduit that is configured to convey relief exhaust gases from the lower cowl volume outlet through the engine compartment to the atmosphere.

10. The outboard motor according to claim 9, wherein the conduit has a first end connected to the lower cowl volume outlet and a second end connected to an opening formed in the upper cowl.

11. The outboard motor according to claim 1, comprising an oil sump disposed in the driveshaft housing.

12. The outboard motor according to claim 1, wherein the lower cowl volume surrounds the driveshaft housing.

13. A method of expanding relief exhaust gases in an outboard motor having an adapter plate that supports an internal combustion engine, a driveshaft housing that is suspended below the adapter plate, and a lower cowl that surrounds the driveshaft housing, the method comprising:

supplying relief exhaust gases to an exhaust gas volume that is at least partially separated from the lower cowl volume by the driveshaft housing and then to a lower cowl volume that is defined between the adapter plate, the lower cowl and the driveshaft housing, wherein the lower cowl volume is configured to cause expansion of the relief exhaust gases; and discharging the relief exhaust gases to atmosphere without passing through an intervening labyrinth structure.

14. The method according to claim 13, comprising supplying the relief exhaust gases to the lower cowl volume via a lower cowl volume inlet and discharging relief exhaust gases to the atmosphere via a lower cowl volume outlet.

15. An outboard motor comprising:

an internal combustion engine an adapter plate that supports the engine;

a driveshaft housing that is suspended below the adapter plate;

a lower cowl that surrounds the driveshaft housing;

a gear case housing that is disposed below the driveshaft housing and that contains a transmission for the outboard motor;

a lower cowl volume that is defined between the adapter plate, the lower cowl and the driveshaft housing;

an exhaust tube that is configured to convey exhaust gas from the engine past the lower cowl volume for discharge from the outboard motor via the gear case housing, wherein the exhaust tube is configured to discharge the exhaust gas to an exhaust gas volume that is located below the lower cowl volume; and a relief exhaust passage having a first end receiving the relief exhaust gases from the exhaust gas in exhaust gas volume and a second end discharging the relief exhaust gases to the lower cowl volume;

wherein the relief exhaust passage extends through the driveshaft housing;

wherein the lower cowl volume is configured to cause expansion of the relief exhaust gases prior to discharge of the relief exhaust gases to the atmosphere without passing through an intervening labyrinth structure;

wherein the exhaust gas volume is at least partially separated from the lower cowl volume by the driveshaft housing.

16. The outboard motor according to claim 15, wherein the lower cowl volume surrounds the driveshaft housing.

17. The outboard motor according to claim 16, wherein the engine is located in an engine compartment defined by an upper cowl that is supported by the adapter plate; and further comprising a cowl seal between the adapter plate and the lower cowl, wherein the cowl seal separates the engine compartment from the lower cowl volume.

* * * * *